US006169867B1

(12) United States Patent
Kurihara

(10) Patent No.: US 6,169,867 B1
(45) Date of Patent: Jan. 2, 2001

(54) TONER-GUIDING SHEET, CLEANING APPARATUS, PROCESS CARTRIDGE, AND IMAGE FORMING APPARATUS

(75) Inventor: Satoshi Kurihara, Toride (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/524,685

(22) Filed: Mar. 14, 2000

(30) Foreign Application Priority Data

Mar. 16, 1999 (JP) ..... 11-070336
Jan. 31, 2000 (JP) ..... 12-021567

(51) Int. Cl.[7] ..... A46B 15/00; G03G 15/20
(52) U.S. Cl. ..... 399/123; 399/105; 15/256.5
(58) Field of Search ..... 15/1.51, 256.5, 15/256.51; 399/102, 103, 105, 139, 111, 123, 343, 345, 358

(56) References Cited

U.S. PATENT DOCUMENTS

| | | | | |
|---|---|---|---|---|
| 4,218,132 | * | 8/1980 | Iwai et al. | 399/123 |
| 4,357,098 | * | 11/1982 | Endo | 399/105 |
| 4,742,797 | * | 5/1988 | Barker | 399/105 |
| 5,617,194 | * | 4/1997 | Morishita et al. | 399/349 |
| 5,689,772 | | 11/1997 | Fujiwara et al. | 399/106 |
| 5,768,660 | | 6/1998 | Kurihara et al. | 399/111 |
| 5,870,654 | | 2/1999 | Sato et al. | 399/109 |
| 5,920,753 | | 7/1999 | Sasaki et al. | 399/111 |
| 6,061,546 | * | 5/2000 | Sawamura et al. | 399/358 |

FOREIGN PATENT DOCUMENTS 6-195006 7/1994 (JP) .

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

A toner-guiding sheet for guiding toner removed from an image carrying member. The sheet includes a free end portion for contacting a surface of the image carrying member, and a fixed portion, fixable on a fixing member, for fixing the toner-guiding sheet in a state in which the free end portion contacts the surface of the image carrying member. The toner-guiding sheet includes a film having a creep-deformation resisting property such that, when the film, fixed on the fixing member so that a distance β from a central portion in a longitudinal direction of the fixed portion of the sheet to a central portion in a longitudinal direction of the free end portion of the sheet is substantially 3.86 mm, is brought in contact with a surface of a contact member under conditions such that a distance α from the central portion in the longitudinal direction of the fixed portion of the sheet to a central portion in the longitudinal direction of a contact portion of the free end portion on the surface of the contact member is substantially 1.86 mm, an amount of penetration δ of the central portion in the longitudinal direction of the contact portion of the sheet with respect to the contact member is substantially 2.0 mm, and an amount of charge ξ of the central portion in the longitudinal direction of the contact portion of the sheet with respect to the contact member is substantially 0.74 mm, a change in the amount of penetration δ when leaving the toner-guiding sheet in an environment of a temperature of substantially 45° C./a humidity of substantially 60% RH for substantially 30 days is equal to or less than substantially 0.43 mm.

46 Claims, 10 Drawing Sheets

TONER-GUIDING SHEET, CLEANING APPARATUS, PROCESS CARTRIDGE, AND IMAGE FORMING APPARATUS

BACKGROUND OF THE INVENTION

1. Field of the Invention

The present invention relates to a toner-guiding sheet mounted in a cleaning apparatus for cleaning toner removed from the surface of an image carrying member in an electrophotographic method, a cleaning apparatus for cleaning the surface of an image carrying member, serving as a member to be cleaned, a process cartridge having the cleaning apparatus as at least one process means, and an image forming apparatus having the process cartridge.

2. Description of the Related Art

In general, in an image forming apparatus which uses a rotating-drum-type image carrying member having a photoconductive photosensitive layer on its outer circumferential surface, and which repeats the process of forming an electrostatic latent image on the photosensitive member while rotating the image carrying member, developing the electrostatic latent image using toner, and transferring the obtained toner image onto a transfer material, toner particles and other adhering matter remaining on the surface of the image carrying member are sufficiently removed by a cleaning apparatus after completing one image forming process and before starting the next image forming process. The cleaning apparatus includes a cleaning blade for scraping off toner particles remaining on an image carrying member while contacting the surface of the image carrying member, a toner-guiding sheet which is provided below the cleaning blade in a state of contacting the surface of the image carrying member in order to scoop the scraped toner particles, and a waste-toner reservoir for storing the scraped waste toner particles. The cleaning blade and the toner-guiding sheet are provided so as to contact the surface of the image carrying member. The toner-guiding sheet is mounted at a predetermined position (hereinafter termed a "mounting surface") of the waste-toner reservoir using a pressure sensitive adhesive double coated tape.

However, since the toner-guiding sheet is made of a monolayer polyethylene terephthalate (PET) film and always contacts the image carrying member, the toner-guiding sheet is subjected to creep deformation so that the distal end of the toner-guiding sheet leaves the image carrying member. Furthermore, since the toner reservoir is formed from a resin material, the mounting surface moves due to a temperature rise of the main body of the apparatus when consecutive image printing operations are performed. As a result of the above-described two types of deformation, when consecutively printing images in a state of a large temperature rise of the main body of the apparatus, there is the possibility that toner particles scraped off by the cleaning blade cannot be assuredly scooped because the distal end of the toner-guiding sheet does not completely contact the image carrying member.

Japanese Patent Laid-Open Application (Kokai) No. 6-195006 (1994) provides a proposal that, after bonding a toner-guiding sheet in a state in which a toner-guiding-sheet bonding surface is curved, the bonded state is released to provide a tension in the longitudinal direction, so that undulation of the distal end of the toner-guiding sheet is prevented, and toner particles scraped off by the cleaning blade can be assuredly scooped because the toner-guiding sheet tightly contacts the surface of the photosensitive member.

However, although the toner-guiding sheet bonded in the above-described manner excellently operates at first, the above-described problem, that the distal end of the toner-guiding sheet is deformed so as to leave the image carrying member when consecutively printing images in a state of a large temperature rise of the main body of the apparatus, is still present. Furthermore, since the distal end of the toner-guiding sheet contacts the surface of the photosensitive member in a state of always being applied with tension in the longitudinal direction, creep deformation of the toner-guiding sheet tends to occur in a shorter time period. Hence, further improvement is desired in order to achieve higher durability.

SUMMARY OF THE INVENTION

It is an object of the present invention to provide a toner-guiding sheet in which the above-described problems are solved, a cleaning apparatus having the toner-guiding sheet, a process cartridge having the cleaning apparatus, and an image forming apparatus having the process cartridge.

It is another object of the present invention to provide a toner-guiding sheet whose distal end is made of a material which is hardly subjected to creep deformation, in order to assuredly scoop toner particles, a cleaning apparatus having the toner-guiding sheet, a process cartridge having the cleaning apparatus, and an image forming apparatus having the process cartridge.

It is still another object of the present invention to provide a toner-guiding sheet which can assuredly scoop toner particles a larger number of times even when a temperature rise occurs according to consecutive image forming operations, a cleaning apparatus having the toner-guiding sheet, a process cartridge having the cleaning apparatus, and an image forming apparatus having the process cartridge.

According to one aspect, the present invention that achieves these objectives relates to a toner-guiding sheet for guiding toner removed from an image carrying member. The sheet comprises a free end portion for contacting a surface of the image carrying member, and a fixed-portion, fixable on a fixing member, for fixing the toner-guiding sheet in a state in which the free end portion contacts the image carrying member. The toner-guiding sheet comprises a film having a creep-deformation resisting property such that, when the film, fixed on a fixing member so that a distance $\beta$ from a central portion in a longitudinal direction of the fixed portion of the sheet to a central portion in a longitudinal direction of the free end portion of the sheet is substantially 3.86 mm, is brought in contact with a surface of a contact member under conditions such that a distance $\alpha$ from the central portion in the longitudinal direction of the fixed portion of the sheet to a central portion in the longitudinal direction of a contact portion of the free end portion on the surface of the contact member is substantially 1.86 mm, an amount of penetration $\delta$ of the central portion in the longitudinal direction of the contact portion of the sheet with respect to the contact member is substantially 2.0 mm, and an amount of charge $\xi$ of the central portion in the longitudinal direction of the contact portion with respect to the contact member is substantially 0.74 mm, a change in the amount of penetration $\delta$ when leaving the toner-guiding sheet in an environment of a temperature of substantially 45° C./a humidity of substantially 60% RH for substantially 30 days is equal to or less than substantially 0.43 mm.

The toner-guiding sheet also comprises a laminated film having at least a creep-deformation resisting layer between polyester films, a laminated film having at least a creep-deformation resisting layer between polyethylene terephthalate films, or a polyethylene sulfide film. The sheet can have a thickness of substantialy 35–45 μm. In addition, the toner-guiding sheet is fixed in a state in which a tension is applied at least in the longitudinal direction of the free end portion. Also, the toner-guiding sheet can be fixed in a state in which a tension smaller than the tension applied in the longitudinal direction of the free end portion is applied, or a tension is not applied, in the longitudinal direction of the fixed portion. In addition, the toner-guiding sheet can be fixed in a state in which a tension is applied at least in the longitudinal direction of the free end portion, by fixing the fixing member in a curved state and then releasing the curved state. Further, the toner-guiding sheet is fixed so that the amount of penetration with respect to the image carrying member is larger at the central portion in the longitudinal direction of the image carrying member and the sheet than at two end portions thereof in the longitudinal direction.

According to another aspect, the present invention that achieves these objectives relates to a cleaning apparatus comprising cleaning means for removing toner from a surface of an image carrying member, and a toner-guiding sheet for receiving the toner removed from the surface of the image carrying member. The toner-guiding sheet comprises a free end portion for contacting the surface of the image carrying member, and a fixed portion, fixable on a fixing member, for fixing the toner-guiding sheet in a state in which the free end portion contacts the surface of the image carrying member. The toner-guiding sheet comprises a film having a creep-deformation resisting property such that, when the film, fixed on a fixing member so that a distance β from a central portion in a longitudinal direction of the fixed portion of the sheet to a central portion in a longitudinal direction of the free end portion of the sheet is substantially 3.86 mm is brought in contact with a surface of a contact member under conditions such that a distance α from the central portion in the longitudinal direction of the fixed portion of the sheet to a central portion in the longitudinal direction of a contact portion of the free end portion on the surface of the contact member is substantially 1.86 mm, an amount of penetration δ of the central portion in the longitudinal direction of the contact portion of the sheet with respect to the contact member is substantially 2.0 mm, and an amount of charge ξ of the central portion in the longitudinal direction of the contact portion of the sheet with respect to the contact member is substantially 0.74 mm, a change in the amount of penetration δ when leaving the toner-guiding sheet in an environment of a temperature of substantially 45° C./a humidity of substantially 60% RH for substantially 30 days is equal to or less than substantially 0.43 mm.

In this embodiment, the toner-guiding sheet can comprise a laminated film having at least a creep-deformation resisting layer between polyester films, a laminated film having at least a creep-deformation resisting layer between polyethylene terephthalate films, or a polyphenylene sulfide film. In addition, the toner-guiding sheet can have a thickness of substantially 35–45 μm. Also, the toner-guiding sheet can be fixed in a state in which a tension is applied at least in the longitudinal direction of the free end portion, in a state in which a tension smaller than the tension applied in the longitudinal direction of the free end portion is applied, or a tension is not applied, in the longitudinal direction of the fixed portion, or in a state in which a tension is applied at least in the longitudinal direction of the free end portion, by fixing the fixed member in a curved state and then releasing the curved state. Moreover, the toner-guiding sheet is fixed so that the amount of penetration with respect to the image carrying member is larger than at the central portion in the longitudinal direction of the image carrying member and the sheet than at two end portions thereof in the longitudinal direction.

In addition, the toner-guiding sheet is fixed in a state of contacting the free end portion thereof to the surface of the image carrying member under conditions such that a distance a from a central portion of the fixed portion in the longitudinal direction of the fixed portion of the sheet to a central portion in the longitudinal direction of the contact portion on the surface of the image carrying member is substantially 1.76–1.96 mm, a distance b from the central portion in the longitudinal direction of the fixed portion of the sheet to the central portion in the longitudinal direction of the free end portion of the sheet is substantially 3.76–4.96 mm, and an amount of penetration c of the central portion in the longitudinal direction of the contact portion of the sheet with respect to the image carrying member is substantially 2.0–3.0 mm, and an amount of charger d of the central portion of the contact portion in the longitudinal direction of the sheet with respect to the image carrying member is substantially 0.74–0.97 mm.

Also, the toner-guiding sheet is fixed in a state of contacting the free end portion thereof to the surface of the image carrying member under conditions such that a distance a from a central portion in the longitudinal direction of the fixed portion of the sheet to a central portion in the longitudinal direction of the contact portion on the surface of the image carrying member is substantially 1.76–1.96 mm, a distance b from the central portion in the longitudinal direction of the fixed portion of the sheet to the central portion in the longitudinal direction of the free end portion of the sheet is substantially 3.76–4.96 mm, and an amount of penetration c of the central portion in the longitudinal direction of the contact portion of the sheet with respect to the image carrying member is substantially 2.0–3.0 mm, and an amount of charge d of the central portion in the longitudinal direction of the contact portion of the sheet with respect to the image carrying member is substantially 0.74–0.97 mm, and wherein, when the toner-guiding sheet is left in the environment of the temperature of substantially 45° C./the humidity of substantially 60% RH for substantially 30 days, an amount of penetration e of the central portion in the longitudinal direction of the contact portion of the sheet with respect to the image carrying member is substantially 1.57–2.37 mm, and an amount of charge f of the central portion in the longitudinal direction of the contact portion of the sheet with respect to the image carrying member is substantially 0.43–0.55 mm.

According to still another aspect, the present invention that achieves these objectives relates to a process cartridge detachably mountable to a main body of an image forming apparatus, comprising an image carrying member for carrying an electrostatic latent image, cleaning means for removing toner from a surface of the image carrying member, and a toner-guiding sheet for receiving the toner removed from the surface of the image carrying member. The toner-guiding sheet comprises a free end portion, fixable on a fixing member, for contacting a surface of the image carrying member, and a fixed portion for fixing the toner-guiding sheet in a state in which the free end portion contacts the surface of the image carrying member. The toner-guiding sheet comprises a film having a creep-deformation resisting property such that, when the film, fixed on the fixing member so that a distance β from a central portion in a longitudinal direction of the fixed portion of the sheet to a central portion in a longitudinal direction of the free end portion of the sheet is substantially 3.86 mm is brought in contact with a surface of a contact member under conditions such that a distance $\alpha$ from the central portion in the longitudinal direction of the fixed portion of the sheet to a central portion in the longitudinal direction of a contact portion of the free end portion on the surface of the contact member is substantially 1.86 mm, an amount of penetration $\delta$ of the central portion in the longitudinal direction of the contact portion of the sheet with respect to the contact member is substantially 2.0 mm, and an amount of charge $\xi$ of the central portion in the longitudinal direction of the contact portion of the sheet with respect to the contact member is substantially 0.74 mm, a change in the amount of penetration $\delta$ when leaving the toner-guiding sheet in an environment of a temperature of substantially 45° C./a humidity of substantially 60% RH for substantially 30 days is equal to or less than substantially 0.43 mm.

According to still another aspect, the present invention relates to an image forming apparatus to which a process cartridge is detachably mounted for forming an image on a recording sheet. The image forming apparatus comprises mounting means for mounting the process cartridge comprising an image carrying member for carrying an electrostatic latent image, cleaning means for removing toner from a surface of the image carrying member, and a toner-guiding sheet for receiving the toner removed from the surface of the image carrying member by the cleaning means. The image forming apparatus also comprises conveying means for conveying the recording sheet. The toner-guiding sheet comprises a free end portion for contacting the surface of the image carrying member, and a fixed portion, fixable on a fixing member, for fixing the toner-guiding sheet in a state in which the free end portion contacts the surface of the image carrying member. The toner-guiding sheet comprises a film having a creep-deformation resisting property such that, when the film, fixed on the fixing member so that a distance $\beta$ from a central portion in the longitudinal direction of the fixed portion of the sheet to a central portion in a longitudinal direction of the free end portion of the sheet is substantially 3.86 mm is brought in contact with a surface of a contact member under conditions such that a distance $\alpha$ from the central portion in the longitudinal direction of the fixed portion of the sheet to a central portion in the longitudinal direction of a contact portion of the free end portion on the surface of the contact member is substantially 1.86 mm, an amount of penetration $\delta$ of the central portion in the longitudinal direction of the contact portion of the sheet with respect to the contact member is substantially 2.0 mm, and an amount of charge $\xi$ of the central portion in the longitudinal direction of the contact portion of the sheet with respect to the contact member is substantially 0.74 mm, a change in the amount of penetration $\delta$ when leaving the toner-guiding sheet in an environment of a temperature of substantially 45° C./a humidity of substantially 60% RH for substantially 30 days is equal to or less than substantially 0.43 mm.

The foregoing and other objects, advantages and features of the present invention will become more apparent from the following detailed description of the invention taken in conjunction with the accompanying drawings.

DETAILED DESCRIPTION OF THE INVENTION

According to the present invention, in a toner-guiding sheet, a cleaning apparatus, a process cartridge and an image forming apparatus having the above-described configuration, by forming the toner-guiding sheet from a film having a creep-deformation resisting property, it is possible to suppress creep deformation in a direction of leaving of the distal end of the toner-guiding sheet from the image carrying member. Furthermore, even when the toner-guiding-sheet mounting surface of the waste-toner reservoir is deformed due to a temperature rise of the main body of the apparatus, produced when consecutively printing images, it is possible to maintain a state in which the distal end of the toner-guiding sheet is assuredly in tight contact with the image carrying member, and to assuredly scoop toner scraped off by the cleaning blade.

The present invention will now be described in further detail.

The toner-guiding sheet of the invention is fixed so that a free end portion of the toner-guiding sheet contacts the surface of the image carrying member, and can scoop toner removed from the surface of the image carrying member. The toner-guiding sheet is made of a film having a creep-deformation resisting property.

Figure 7:
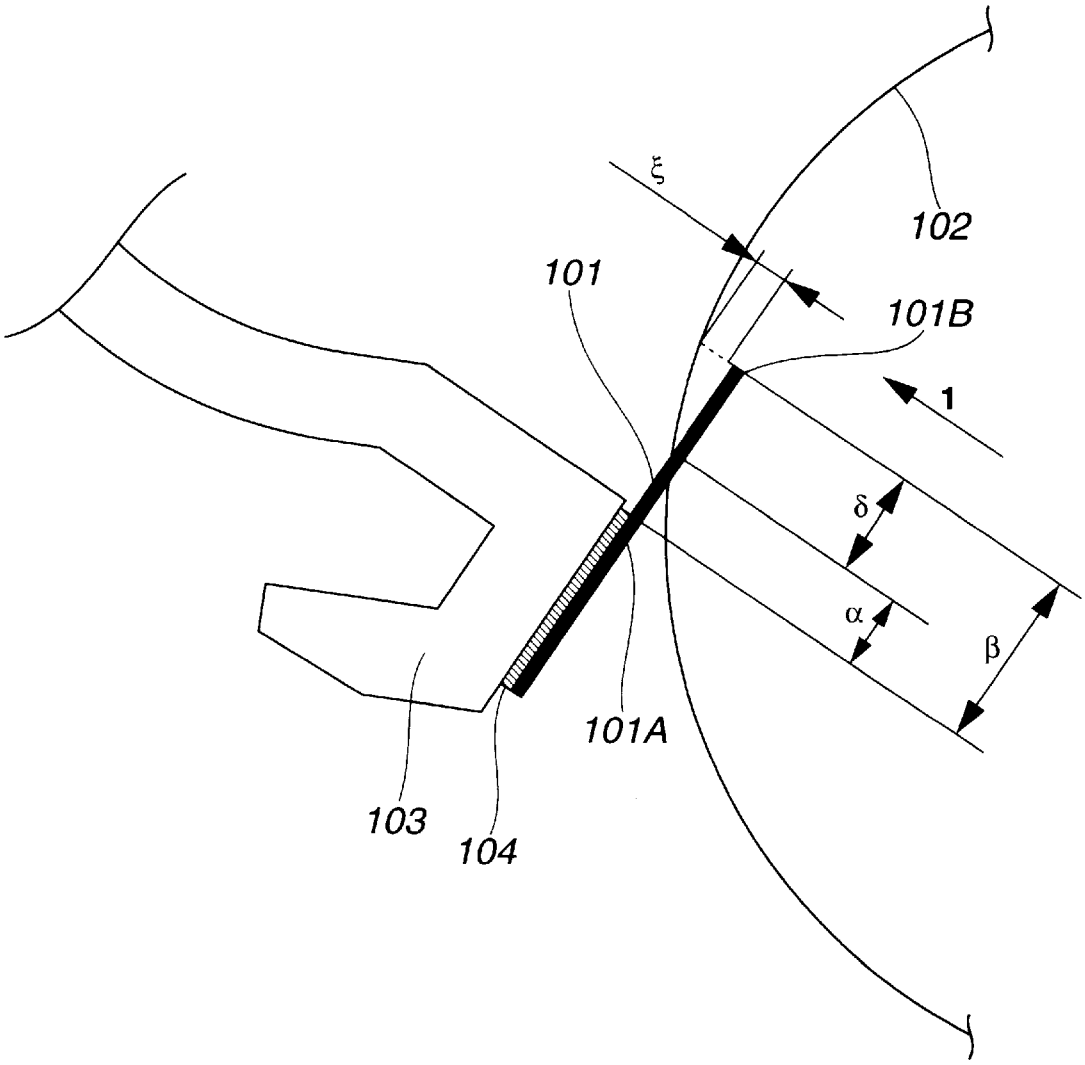
FIG. 7 is a schematic diagram illustrating an amount of penetration and an amount of charge with respect to a contact member for the central portion in the longitudinal direction of a toner-guiding sheet, when measuring a creep-deformation resisting property of a film.

FIG. 7 is a cross-sectional view at a central portion in a longitudinal direction of a film 101 fixed on a fixing member 103.

In the present invention, a film having a creep-deformation resisting property indicates a film having a property such that, as shown in FIG. 7, when a film 101 is fixed on a fixing member 103 so that a distance β from a central portion in a longitudinal direction of a fixed portion 101A of the film 101 to a central portion in a longitudinal direction of a free end portion 101B of the film 101 is 3.86 mm, and the film 101 is brought in contact with a surface of a contact member 102 under conditions such that a distance α from the central portion in the longitudinal direction of the fixed portion 101A of the film 101 of the fixed portion 101A to a central portion in the longitudinal direction of a contact portion of free end portion 101B on the surface of the contact member 102 is 1.86 mm, an amount of penetration δ of the central portion in the longitudinal direction of the contact portion of the film 101 with respect to the contact member 102 is 2.0 mm, and an amount of charge ξ of the central portion in the longitudinal direction of the contact portion of the film 101 with respect to the contact member 102 is 0.74 mm, a change in the amount of penetration δ when leaving the toner-guiding sheet in an environment of a temperature of 45° C./a humidity of 60% RH for 30 days is equal to or less than 0.43 mm (0–0.43 mm). The change is the distance the film's contact portion penetrates the contact member 102 in the radial direction thereof.

In the present invention, in measurement of the creep-deformation resisting property of the film, in order to perform measurement in a state close to the actual state of use of the toner-guiding sheet, a cylindrical member having a diameter of 24 mm is used as the contact member 102, and the fixed portion 101A of the film 101 is fixed on the fixing member 103 using a pressure sensitive adhesive double coated tape 104.

When a change in the amount of penetration δ when leaving the toner-guiding sheet in the above-described environment of a temperature of 45° C./a humidity of 60% RH for 30 days exceeds 0.43 mm, leakage of toner easily occurs due to a deformation of the toner-guiding-sheet mounting surface and creep deformation of the toner-guiding sheet caused by the use for a long time, as a result of a temperature rise of the image forming apparatus when consecutively forming images.

In the present invention, the thickness of the toner-guiding sheet is preferably 35–45 μm, and more preferably 38–40 μm, from the viewpoint of excellently holding toner removed from the surface of the image carrying member, and preventing damage on the surface of the image carrying member.

When the thickness of the toner-guiding member exceeds 45 μm, the rigidity of the toner-guiding sheet increases, thereby tending to cause damage on the surface of the image carrying member after a large number of printing operations in a state in which the toner-guiding sheet is brought in pressure contact with the surface of the image carrying member. Particularly when the surface of the image carrying member is made of a synthetic resin, the surface of the image carrying member tends to be damaged. When the thickness of the toner-guiding sheet is less than 35 μm, since the rigidity of the toner-guiding member decreases, toner removed from the surface of the image carrying member cannot be held.

An ordinary electrophotographic photosensitive member, such as an organic photoconductor (OPC) photosensitive member, an amorphous silicon (a-Si) photosensitive member, a selenium photosensitive member or the like, may be used as the image carrying member to which the toner-guiding sheet of the invention can be applied. An OPC photosensitive member, or a photosensitive member including an OPC photosensitive member having a surface layer made of a synthetic resin formed on the surface thereof may be specifically used as the above-described image carrying member having a surface made of a synthetic resin formed thereon.

The toner-guiding sheet of the invention is preferably fixed in a state in which a tension is applied at least in the longitudinal direction of the free end portion, from the viewpoint of preventing leakage of toner because undulation at the free end portion of the toner-guiding sheet is not produced and a gap is hardly produced when the toner-guiding sheet is brought in pressure contact with the surface of the image carrying member.

Figure 8:
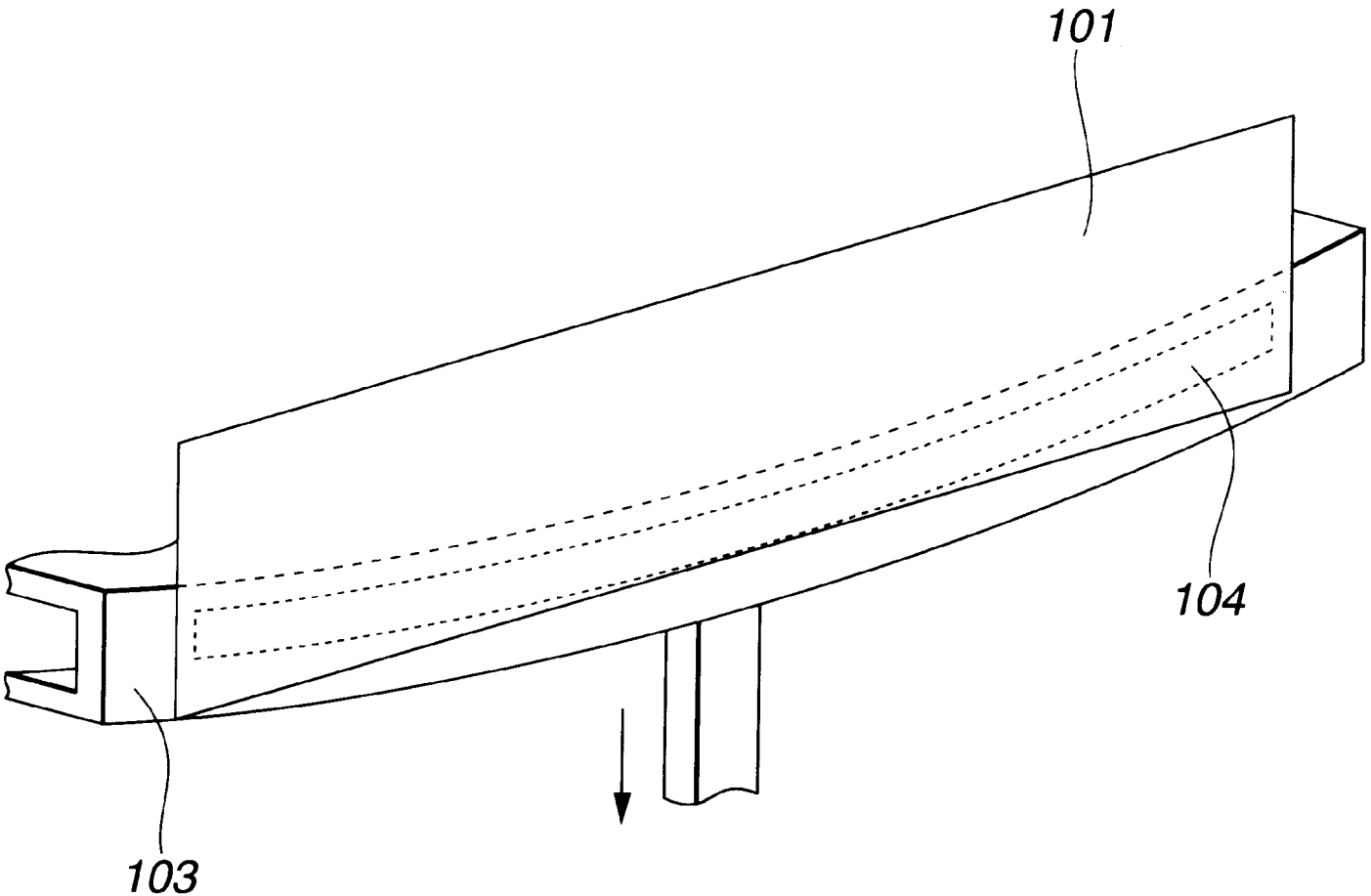
FIG. 8 is a diagram illustrating a state in which a toner-guiding sheet is bonded and fixed on a toner-guiding-sheet fixing member in a state in which the bonding surface of the toner-guiding-sheet fixing member is curved.
Figure 9:
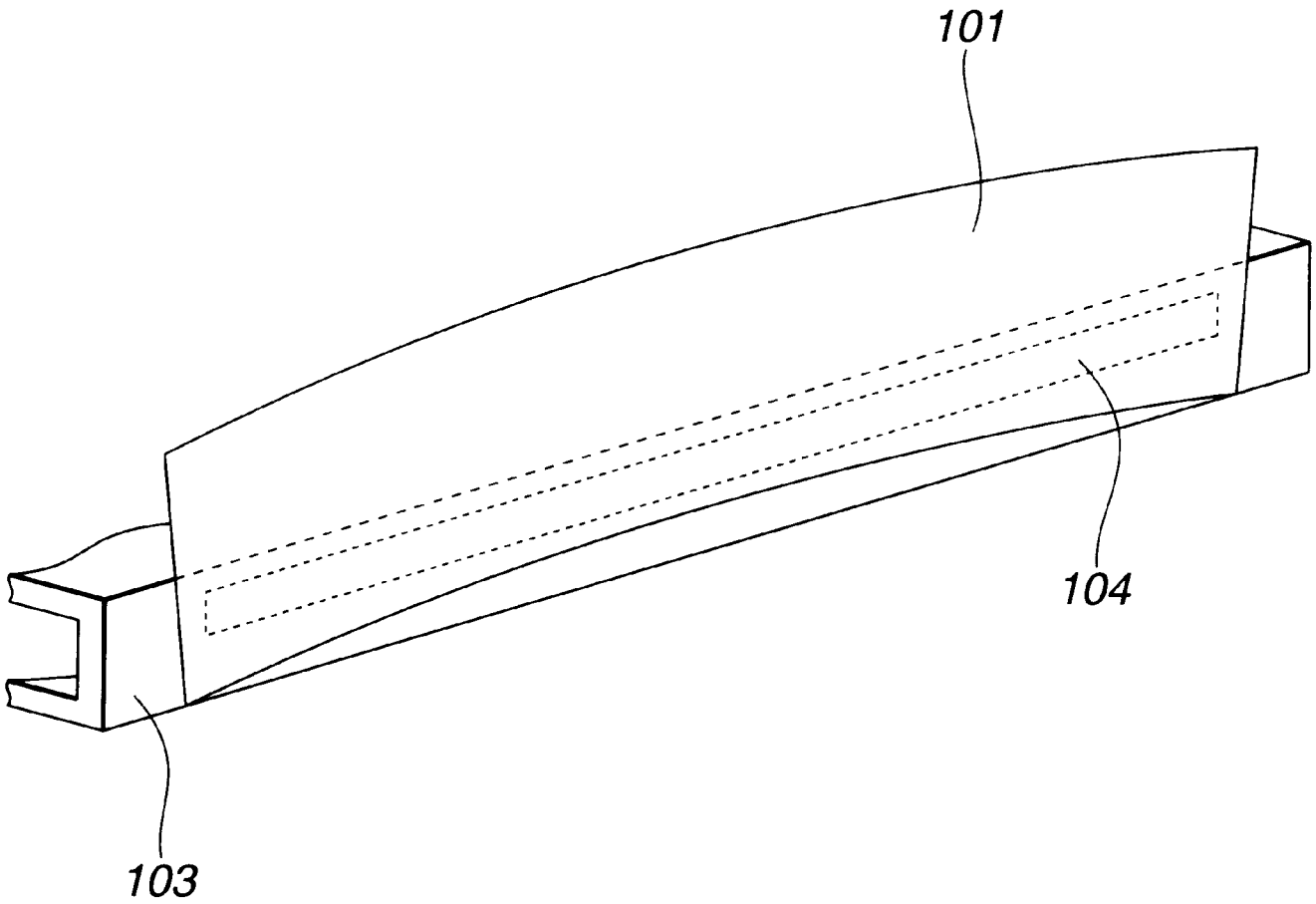
FIG. 9 is a diagram illustrating a state in which a tension is applied in the longitudinal direction of the toner-guiding sheet by releasing the curved state of the toner-guiding-sheet fixing member by restoring the toner-guiding sheet fixing member.

In order to fix the toner-guiding sheet in a state in which a tension is applied at least in the longitudinal direction of the free end portion of the toner-guiding sheet, for example, after fixing the toner-guiding sheet 101 on the fixing member 103 in a state in which the bonding surface of the fixing member 103 for the toner-guiding sheet 101 is curved, using the pressure sensitive adhesive double coated tape 104 as shown in FIG. 8, tension may be applied in the longitudinal direction of the toner-guiding sheet 101 by fixing the fixing member 103 in a curved state and then releasing the curved state by restoring the bonding surface of the fixing member 103 as shown in FIG. 9.

When a rectangular film is used as the toner-guiding sheet, and is fixed on the bonding surface of the fixing member as shown in FIGS. 8 and 9, the toner-guiding sheet is fixed so that the amount of penetration with respect to the image carrying member is larger at a central portion of the image carrying member and of the sheet than at both end portions in the longitudinal direction. This state is preferable because the distal end of the toner-guiding sheet can always tightly contact the image carrying member even at the central portion in the longitudinal direction where the amount of deformation of the toner-guiding-sheet mounting surface of the waste-toner reservoir is largest, when consecutively forming images in a state of a large temperature rise of the main body of the apparatus.

For example, (A) a laminated film having at least a creep-deformation resisting layer between polyester films, such as polyethylene terephthalate films or the like, or (B) a polyphenylene sulfide film may be used as the creep-deformation resisting film used for the toner-guiding sheet of the invention in which a change in the amount of penetration δ when leaving the toner-guiding sheet in the environment of the temperature of 45° C./ the humidity of 60% RH for 30 days is equal to or less than 0.43 mm.

The creep-deformation resisting film in the above-described laminated film (A) may comprise an adhesive layer containing at least an inorganic compound and an adhesive.

This adhesive layer containing the inorganic compound preferably contain a powder inorganic compound which is insoluble in the adhesive and has an average particle diameter equal to or less than 80% of the thickness of the adhesive layer, within a range of 60–400 weight parts with respect to 100 weight parts of the adhesive.

The thickness of the adhesive layer containing the inorganic compound is preferably within a range of 20%–100% of the total thickness of the two polyethylene terephthalate (polyester) films.

The average particle diameter of the powder inorganic compound is represented by a particle diameter corresponding to 50% of the accumulated weight distribution of particle diameters.

When the average particle diameter of the powder inorganic compound exceeds 80% of the thickness of the adhesive layer containing the inorganic compound, the influence of the particle size appears in the external surface of the layer, thereby causing unevenness in the layer or generation of bubbles in the layer, and impairing its external appearance.

When the amount of the inorganic compound contained in the adhesive layer is less than 60 weight parts with respect to 100 weight parts of the adhesive, the creep-deformation resisting property of the laminated film is not sufficiently improved. When the amount of the inorganic compound contained in the adhesive layer exceeds 400 weights parts, it is difficult to uniformly mix and disperse the inorganic compound within the adhesive.

When the thickness of the adhesive layer containing the inorganic compound is less than 20% of the total thickness of the two polyethylene terephthalate (polyester) films, the creep-deformation resisting property of the laminated film is not sufficiently improved. When the thickness of the adhesive layer containing the inorganic compound exceeds 100% of the total thickness of the two polyethylene terephthalate (polyester) films, it is difficult to coat an adhesive composite containing the inorganic compound and the adhesive on the film, and it is uneconomical.

A solventless hot-melt adhesive or a reaction-curing adhesive of each type, such as an epoxy-type, a urethane-type, a polyester-type, an ethylene-vinyl acetate-type or the like, is preferably used as the adhesive. Only one of these adhesives may be used, or at least two of these adhesives may be mixed. At least one of a stabilizer, an antioxidant, a plasticizer, a tackifier, a filler, a pigment and the like may be added if necessary.

When using a solvent-type adhesive, if a large amount of an inorganic compound is added to the adhesive, the viscosity of the solution and the stirring method must be considerably controlled in order to realize uniform mixture. When coating an adhesive composite containing the inorganic compound and the solvent-type adhesive to a relatively large thickness, considerable time is required for drying the adhesive composite, and there are also other problems in handling the composite, such as the working environment and the like.

The inorganic compound is preferably in the form of powder which is insoluble in the adhesive. The use of a flame retarder which is dissolvable in the adhesive is not preferable because the interlayer adhesive strength of the adhesive is weakened.

A compound containing halogen, such as hexabromobenzene, tetrabromophthalimide, tetrabromophthalic anhydride, decabromodiphenyl ether or the like, antimony trioxide, alminum hydroxide or the like may be used as the inorganic compound. At least one of these compounds may be appropriately combined. It is also possible to add a small amount of soluble inorganic compound within a range of not degrading the interlayer adhesive strength.

A film commercially available with a trade name of "DIALAMY" made by Mitsubishi Plastics Industries Limited may be used as the above-described laminated film (A) having at least a creep-deformation resisting layer between polyester films, such as polyethylene terephthalate films.

A film commercially available with a trade name of "Torelina" made by Toray Industries Inc. may be used as the above-described polyphenylene sulfide film (B).

Next, the cleaning apparatus, the process cartridge and the image forming apparatus in which the tone-guiding sheet of the invention is used will be described in further detail with reference to the drawings.

Figure 1:
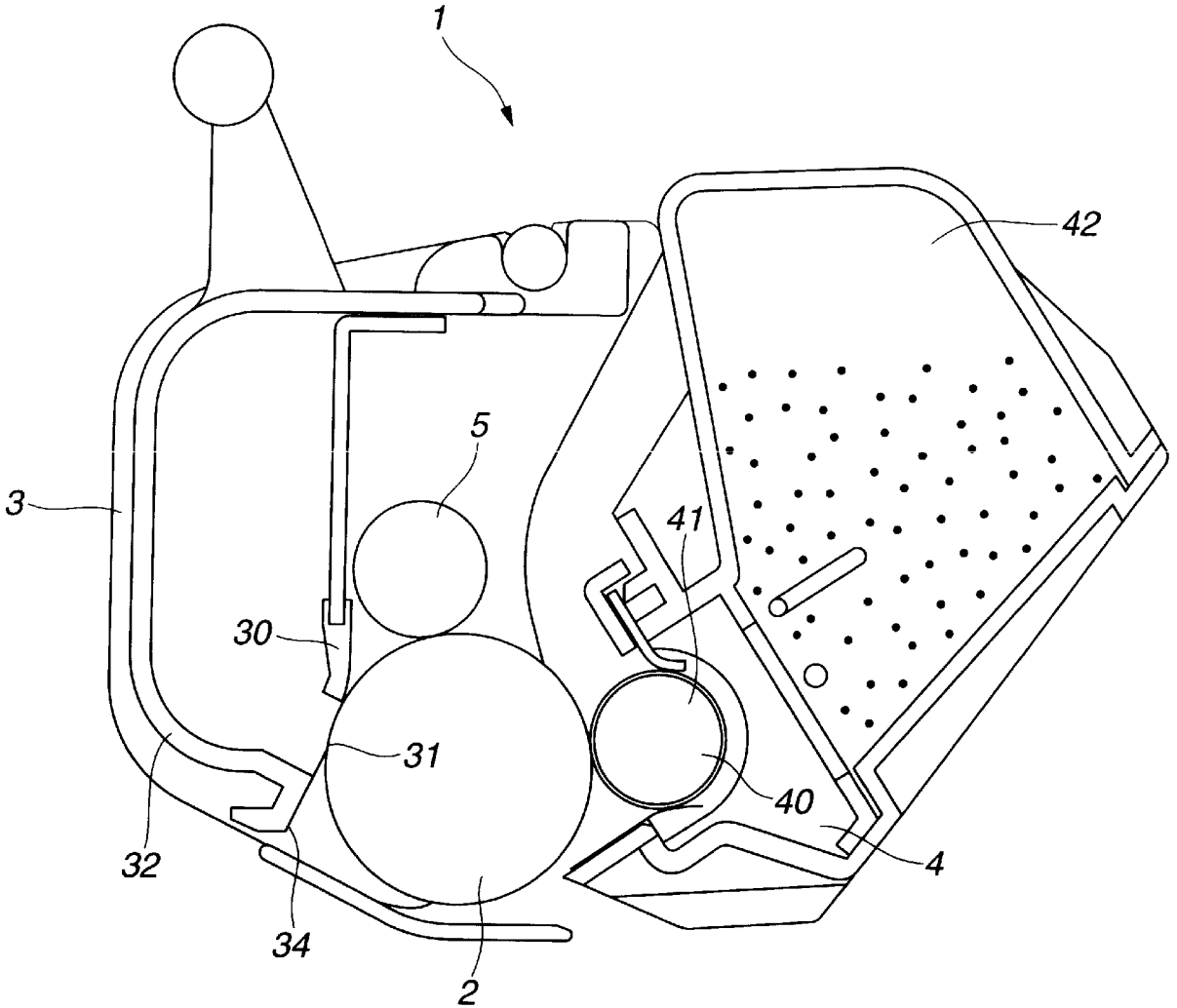
FIG. 1 is a cross-sectional view of a process cartridge including a cleaning apparatus according to the present invention.

FIG. 1 is a cross-sectional view of a process cartridge 1 which integrates a cleaning apparatus of the invention and which is detachably mountable in an image forming apparatus.

A photosensitive drum (image carrying member) 2, serving as process means, and a cleaning apparatus 3, a developing unit 4 and a primary charger 5 which are disposed around the photosensitive drum 2 are disposed within the receptacle of the process cartridge 1. These units are detachably mounted in the image forming apparatus in a state of integrally being supported by the main body of the apparatus. When, for example, the photosensitive drum 2 or the developing unit 4 reaches the end of its life, or toner (a developer) within the developing unit 4 is used up, by exchanging the entire process cartridge 1, maintenance is easily performed.

The cleaning apparatus 3 includes process means including a cleaning blade 30 for removing remaining toner particles from the photosensitive drum 2, a toner-guiding sheet 31 for preventing the removed remaining toner particles from leaking to the outside, and the like, and a waste-toner receptacle 32 for storing the remaining toner particles.

The developing unit 4 rotates in a predetermined direction, and includes process means including a developing sleeve 40 for supplying the photosensitive drum 2 with toner (a developer) held on its outer circumferential portion, developing blade 41 for regulating the thickness of the toner layer on the developing sleeve 40, and the like, a toner receptacle 42 for storing toner and supplying the developing sleeve 40 with the toner, and the like.

An image forming process performed by the image forming apparatus using the above-described process cartridge 1 will now be described with reference to FIG. 10. When image light L is projected onto the photosensitive drum 2 uniformly charged by the primary charger 5, an electrostatic latent image is formed on the photosensitive drum 2. The electrostatic image is fed to the developing unit 4 in accordance with the rotation of the photosensitive drum 2, and is visualized as a toner image by supplying the toner from the developing sleeve 40 of the developing unit 4. The toner image is transferred onto a transfer sheet 51 by a transfer charger 50. The transferred toner image is then fixed by a fixing unit 52 to provide a fixed image. After completion of the image transfer, toner particles remaining on the photosensitive drum 2 are removed by the cleaning blade 30 tightly contacing the photosensitive drum 2, in order to prepare for the next image forming operation. The waste toner particles removed by the cleaning blade 30 are accumulated within the waste-toner receptacle 32 of the cleaning apparatus 3 via the toner-guiding sheet 31 tightly contacting the photosensitive drum 2.

Next, the toner-guiding sheet 31 provided in the cleaning apparatus 3 of the process cartridge will be described in detail with reference to FIGS. 2, 3A and 3B.

Figure 2:
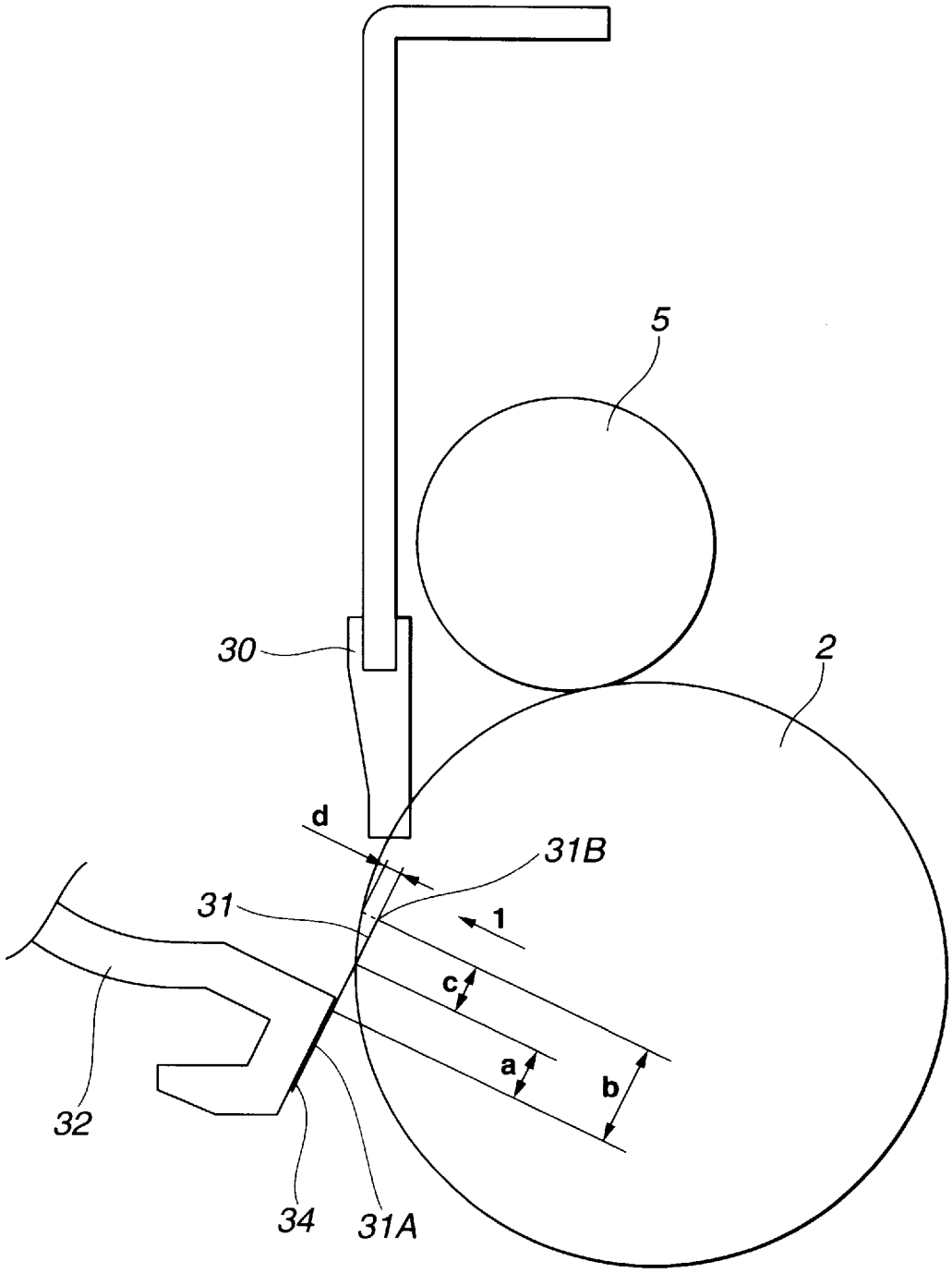
FIG. 2 is a schematic diagram illustrating the relationship between a toner-guiding sheet and a photosensitive drum in a state in which the central portion in the longitudinal direction of the toner-guiding sheet is fixed.
Figure 3A:
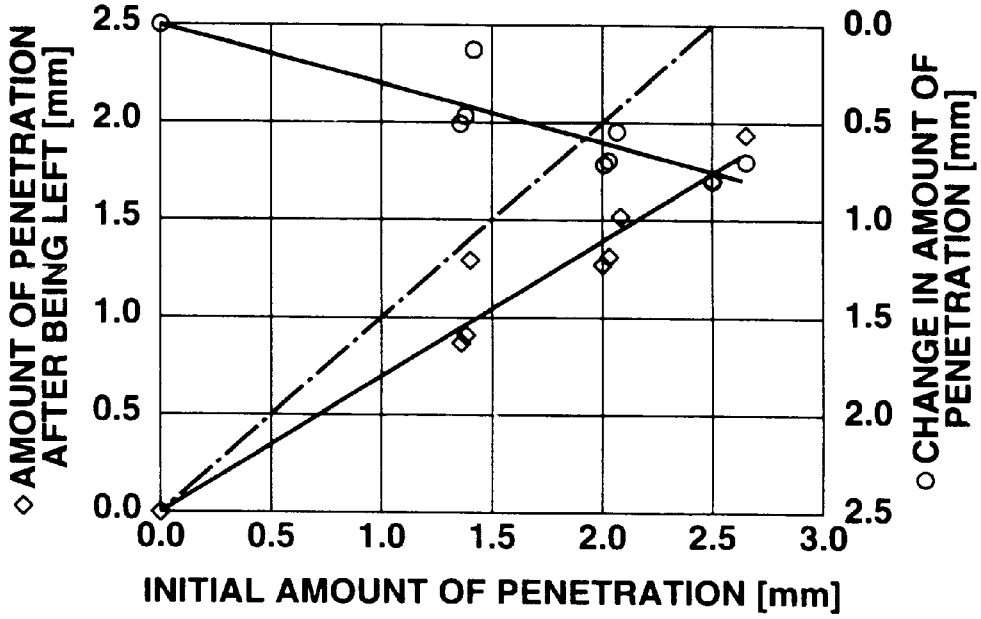
FIGS. 3A and 3B are graphs illustrating changes in an amount of penetration and changes in an amount of charge, respectively, due to creep deformation in a toner-guiding sheet made of a monolayer polyester film.
Figure 3B:
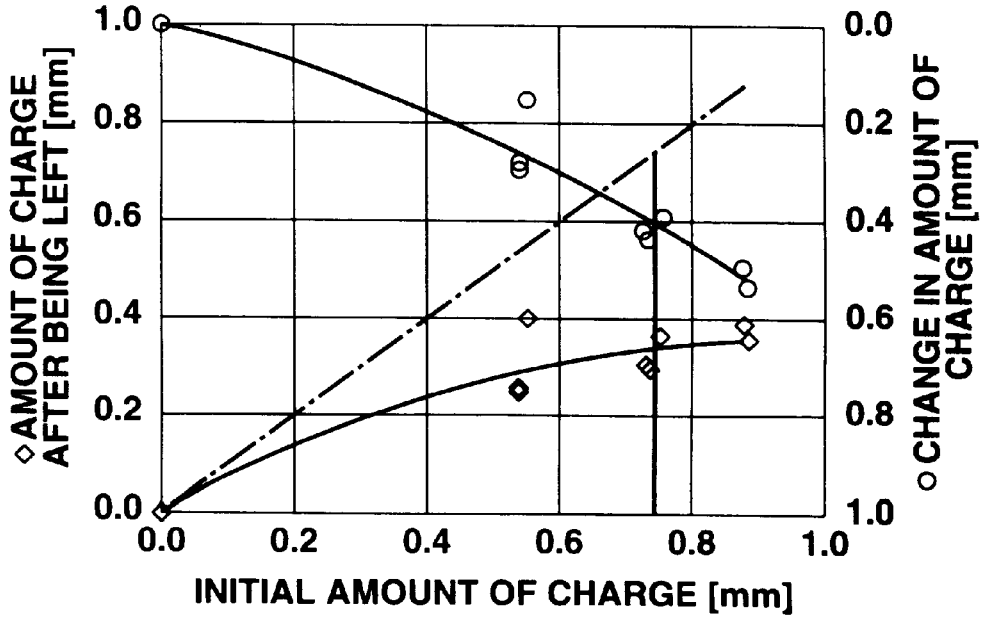

In FIG. 2, the toner-guiding sheet 31 is bonded and fixed on a toner-guiding-sheet mounting surface 34 of the waste-toner receptacle 32 in a state in which undulation is suppressed as much as possible by applying a tension in the longitudinal direction of the free end portion of the toner-guiding-sheet 31, in order to receive a large amount of toner particles scraped off and dropped from the cleaning blade 30 at one time, without being dropped onto the main body of the apparatus and without being dispersed. The toner-guiding sheet 31 is preferably fixed in a state of contacting a free end portion 31B thereof to the surface of the photosensitive drum 2 under conditions such that a distance "a" from a central portion in the longitudinal direction of a fixed portion 31A of the toner-guiding sheet 31 to a central portion in the longitudinal direction of the contact portion of the free end portion 31B on the surface of the photosensitive drum 2 is 1.76–1.96 mm, a distance b from the central portion in the longitudinal direction of the fixed portion 31A of the toner-guiding sheet 31 to a central portion in the longitudinal direction of the free end portion 31B of the toner-guiding sheet 31 is 3.76–4.96 mm, and an amount penetration c of the central portion in the longitudinal direction of the contact portion of the sheet 31 with respect to the photosensitive drum 2 is 2.0–3.0 mm, and an amount of charge d of the central portion in the longitudinal direction of the contact portion of sheet 31 with respect to the photosensitive drum 2 is 0.74–0.97 mm. The charge d is the distance the free end portion 31B penetrates the drum 2 in the radial direction of the drum 2.

When the amount of penetration c is less than 2.0 mm, the phenomenon that toner particles scraped off by the cleaning blade 30 cannot be scooped tends to occur. When the amount of penetration c exceeds 3.0 mm, a toner blocking phenomenon between the cleaning blade 30 and the toner-guiding sheet 31 tends to occur.

In the present invention, since the toner-guiding sheet 31 is made of a creep-deformation resisting film as described above, creep deformation is suppressed even if the toner-guiding sheet 31 contacts the photosensitive drum 2 in a state in which the distal end of the toner-guiding sheet 31 always receives a certain amount of force from the photosensitive drum 2. More specifically, it is preferable that, when leaving the toner-guiding sheet 31 in the environment of a temperature of 45° C./a humidity of 60% RH for 30 days in the above-described fixed state, the amount of penetration e of the central portion in the longitudinal direction of the contact portion with respect to the photosensitive drum 2 is 1.57–2.37 mm, and the amount of charge f of the central portion in the longitudinal direction of the contact portion with respect to the photosensitive drum 2 is 0.43–0.55 mm, and the difference (c–e) between the initial amount of penetration c and the amount of penetration e after being left is 0.43–0.63 mm, and the difference (d–f between the initial amount of charge d and the amount of charge after being left f is 0.31–0.42 mm.

If the difference c–e between the initial amount of penetration and the amount of penetration after being left is larger than the above-described range, the phenomenon that toner particles scraped off by the cleaning blade 30 cannot be scooped tends to occur.

If the difference d–f between the initial amount of charge and the amount of charge after being left is larger than the above-described range, the phenomenon that toner particles scraped off by the cleaning blade 30 cannot be scooped tends to occur.

Figure 4A:
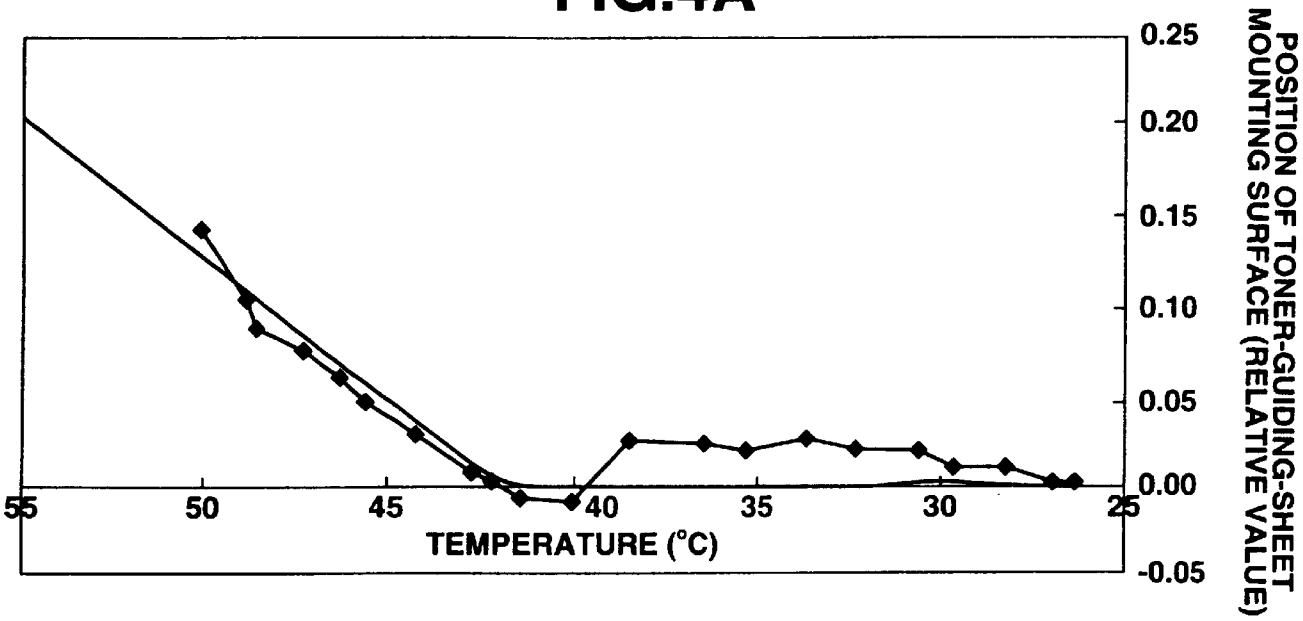
FIG. 4 is a graph illustrating the relationship between the temperature and the amount of deformation of a toner-guiding-sheet mounting surface.
Figure 4B:
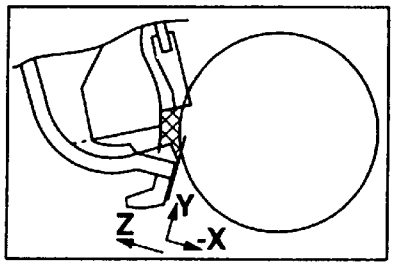

As described above, the waste-toner receptacle 32 which bonds the toner-guiding sheet 31 is formed from a resin material. Particularly in the main body of an image forming apparatus which does not have a cooling fan or the like, when, for example, the temperature of the main body of the apparatus is raised by heat from the fixing unit or other electronic components during consecutive printing operations, the waste-toner receptacle 32 is deformed by the temperature rise, so that the toner-guiding-sheet mounting surface is also deformed so as to leave the photosensitive drum 2, as indicated by an arrow Z shown in FIG. 4. Conventionally, the toner-guiding sheet 31 is subjected to creep deformation in such a case. When a printing operation is performed in a state in which the temperature of the main body is raised to 50° C.–60° C., and a small amount of undulation equal to or less than 0.1 mm is present at the distal end of the toner-guiding sheet 31, the distal end of the toner-guiding sheet 31 cannot be completely in tight contact with the photosensitive drum 2, and toner particles scraped off by the cleaning blade 30 cannot be assuredly scooped. To the contrary, since the toner-guiding sheet 31 of the present invention is made of a creep-deformation resisting film, and as described above, the difference between the initial amount of penetration and the amount of penetration after being left in a high-temperature environment for a long time, and the difference between the initial amount of charge and the amount of charge after being left in the high-temperature environment are suppressed to small values, the conventional problem due to deformation of the waste-toner receptacle 32 is solved. Hence, it is possible to maintain a state in which the distal end of the toner-guiding sheet 31 tightly contacts the photosensitive drum 2, and to assuredly scoop toner particles scraped off by the cleaning blade 30.

As described above, according to the present invention, by forming the toner-guiding sheet by a creep-deformation resisting film, it is possible to provide a toner-guiding sheet, a cleaning apparatus, a process cartridge and an image forming apparatus in which the amount of creep deformation of the distal end portion of the toner-guiding sheet in a direction of leaving the image carrying member can be suppressed, and even when the toner-guiding-sheet mounting surface of the waste-toner reservoir is deformed as a result of a temperature rise of the main body of the apparatus during consecutive image printing operations, the distal end of the toner-guiding sheet is completely in tight contact with the image carrying member, and toner particles scraped off by the cleaning blade can be assuredly scooped.

EXAMPLE 1

Toner-guiding sheets were formed by cutting a laminated film 40 $\mu$m thick having at least a creep-deformation resisting layer between polyester (polyethylene terephthalate) films (trade name: "DIALAMY" made by Mitsubishi Plastic Industries Limited) into rectangles 234 mm long and 7.9 mm wide.

This film was confirmed to have a change in the amount of penetration $\delta$ when being left in the environment of a temperature of 4520 C./a humidity of 60% RH for 30 days of 0.43 mm, and to have a creep-deformation resisting property in the invention.

The formed toner-guiding sheet 31 was bonded and fixed on the waste-toner receptacle 32 of the process cartridge 1 shown in FIG. 1 using a pressure sensitive adhesive double coated tape. When bonding the toner-guiding sheet 31, after bonding and fixing the toner-guiding sheet 31 in a state in which the bonding surface of the waste-toner receptacle 32 is curved as shown in FIG. 8, a tension is applied in the longitudinal direction of the free end portion 31B of the toner-guiding sheet 31 by releasing the curved state by restoring the waste-toner receptacle 32. The free end portion 31B of the fixed toner-guiding sheet 31 contacts the surface of the photosensitive drum 2 under conditions such that a distance "a" from a central portion in the longitudinal direction of a fixed portion 31A of the toner-guiding sheet 31 to a central portion in the longitudinal direction of a contact portion of the free end portion on the surface of the photosensitive drum 2 is 1.86 mm, a distance b from the central portion in the longitudinal direction of the fixed portion 31A of the toner-guiding sheet 31 to a central portion in the longitudinal direction of the free end portion 31B of the toner-guiding sheet 31 is 3.86 mm, and an amount penetration c of the central portion in the longitudinal direction of the contact portion of the sheet 31 with respect to the photosensitive drum 2 is 2.0 mm, and an amount of charge d of the central portion in the longitudinal direction of the contact portion of the sheet 31 with respect to the photosensitive drum 2 is 0.74 mm.

Figure 5A:
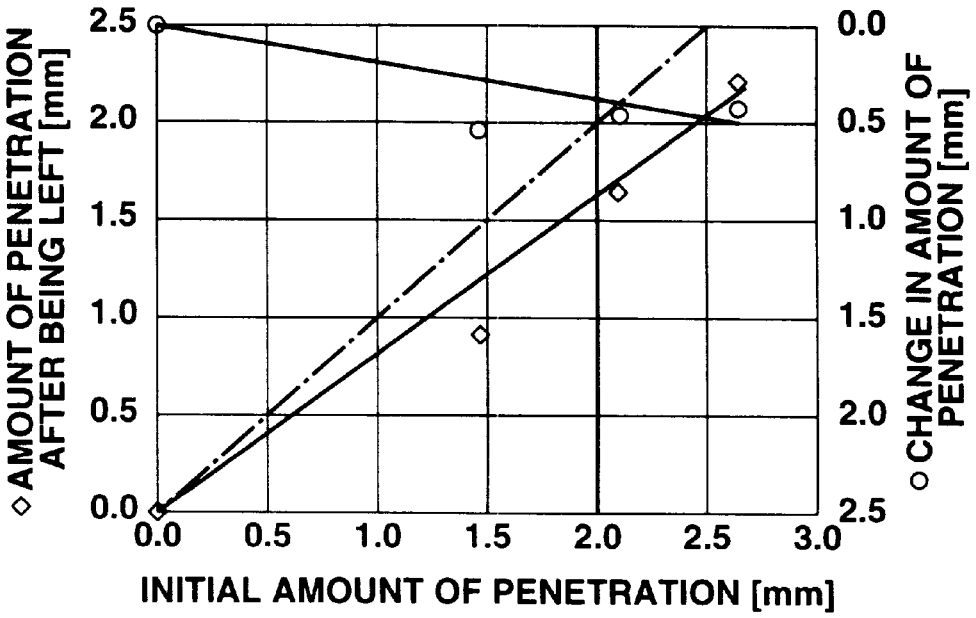
FIGS. 5A and 5B are graphs illustrating changes in an amount of penetration and changes in an amount of charge, respectively, due to creep deformation in a toner-guiding sheet made of a laminated film having at least a creep-deformation resisting layer between polyethylene terephthalate (polyester) films in Example 1.
Figure 5B:
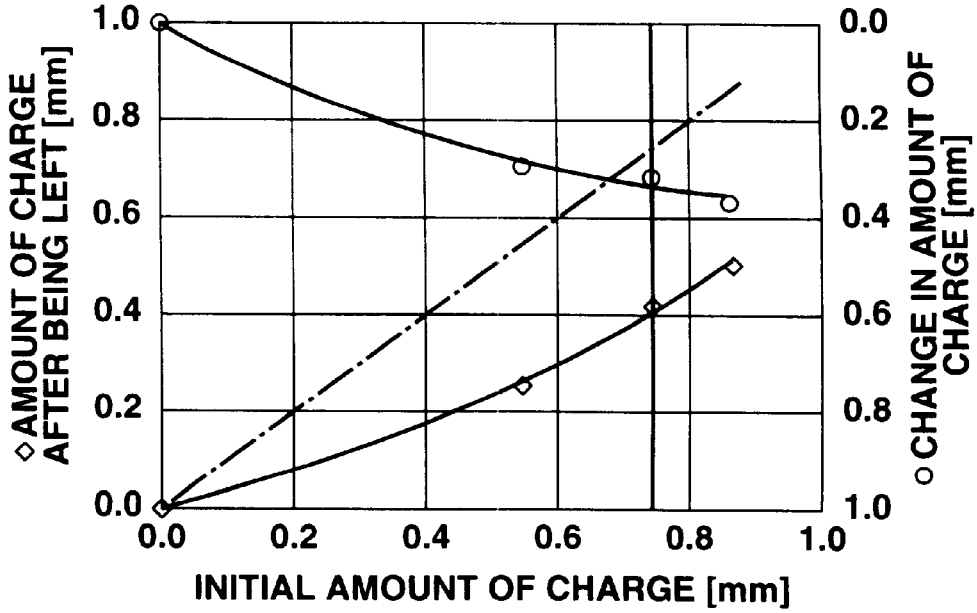

This process cartridge 1 was left in the environment of a temperature of 45° C./a humidity of 60% RH for 30 days in a state in which the process cartridge 1 was assembled. As shown in FIGS. 5A and 5B, the amount of penetration e of the central portion in the longitudinal direction of the contact portion of the sheet 31 with respect to the photosensitive drum 2 was 1.57 mm, and the amount of charge f of the central portion in the longitudinal direction of the contact portion of the sheet 31 with respect to the photosensitive drum 2 was 0.43 mm. Hence, the difference (c–e) between the initial amount of penetration c and the amount of penetration after being left e was 0.43 mm, and the difference (d–f between the initial amount of charge d and the amount of charge after being left f was 0.31.

The waste-toner receptacle 32 which bonds the toner-guiding sheet 31 was formed from a polystyrene resin. Due to a temperature rise within the main body of the image forming apparatus, the waste-toner receptacle 32 is deformed, so that the toner-guiding-sheet mounting surface 34 is also deformed in a direction of leaving the photosensitive drum 2 as indicated by the arrow Z shown in FIG. 4. The amount of deformation of the toner-guiding-sheet mounting surface 34 of the waste-toner receptacle 32 at 50° C. was 0.125 mm, and the amount of deformation at 60° C. (estimated from the graph) was 0.28 mm.

The amount of deformation of the toner-guiding-sheet mounting surface 34 of the waste-toner receptacle 32 at each temperature was measured in the following manner. That is, after leaving the process cartridge into an atmosphere of 60° C. for 8 hours, the process cartridge was immediately brought into an atmosphere of ambient temperature. While the temperature of the toner-guiding-sheet mounting surface 34 of the waste-toner receptacle 34 is lowered to room temperature, the distance from the toner-guiding-sheet mounting surface 34 to the center of axis of the photosensitive drum 2 was measured at each temperature from 50° C. to room temperature.

A test of consecutive image forming operations was performed under the following conditions in which the temperature near the toner-guiding-sheet mounting surface 31 of the waste-toner receptacle 32 is raised to about 56.2° C. The result of the test indicates that a state in which the toner-guiding sheet 31 contacts the surface of the photosensitive drum 2 was maintained, toner particles scraped off by the cleaning blade 30 could be assuredly scooped, and leakage of toner particles did not occur.

Image Forming Conditions

Figure 10:
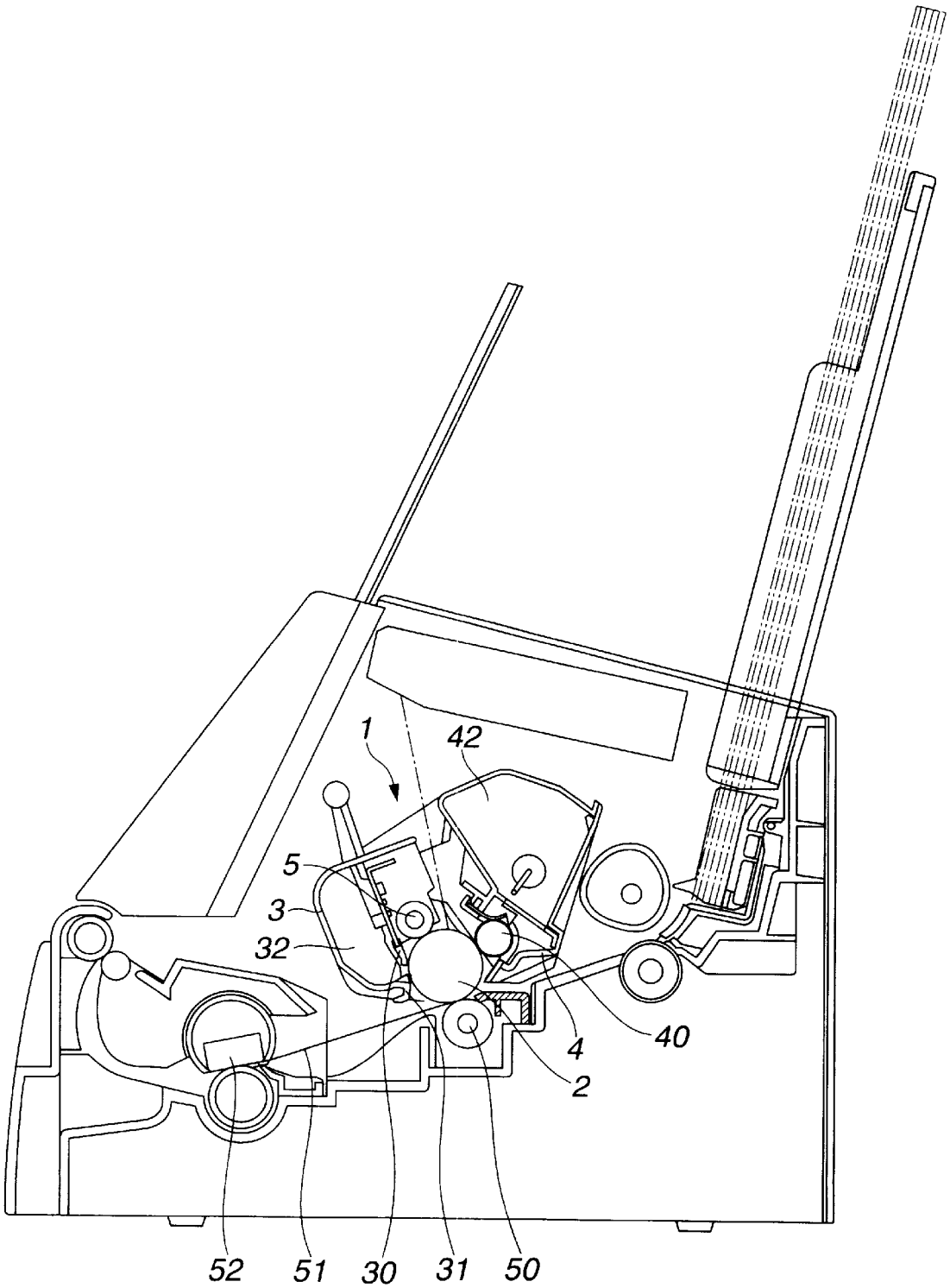
FIG. 10 is a schematic diagram illustrating entirety of an image forming apparatus in which the process cartridge of the invention is mounted.

The process cartridge 1 shown in FIG. 1 was mounted in the main body of the image forming apparatus as shown in FIG. 10. A one-component developer was used as the developer. The process speed was set to 51.62 mm/sec. A heating-roller fixing unit set to a temperature of 185° C. was used as the fixing unit. Consecutive image forming operations for 2,500 sheets were performed in a mode of 2 sheets/3 minutes in which image forming operations are interrupted for 2 minutes 35 seconds, after consecutively passing two sheets for 25 seconds.

The result of the evaluation indicates that, since the toner-guiding sheet 31 is made of a creep-deformation resisting film, and the toner-guiding sheet 31 is fixed in a state in which the free end portion 31B of the fixed toner-guiding sheet 31 contacts the surface of the photosensitive drum 2 under conditions such that a distance "a" from a central portion in the longitudinal direction of the fixed portion 31A of the toner-guiding sheet 31 to a central portion in the longitudinal direction of the contact portion of the free end portion 31B on the surface of the photosensitive drum 2 is 1.86 mm, a distance b from the central portion in the longitudinal direction of the fixed portion 31A of the toner-guiding sheet 31 to a central portion in the longitudinal direction of the free end portion 31B of the toner-guiding sheet 31 is 3.86 mm, and an amount penetration c of the central portion in the longitudinal direction of the contact portion of the sheet 31 with respect to the photosensitive drum 2 is 2.0 mm, and an amount of charge d of the central portion in the longitudinal direction of the contact portion of the sheet 31 with respect to the photosensitive drum 2 is 0.74 mm, the deformation of the waste-toner receptacle 32 due to a temperature rise within the main body of the image forming apparatus could be dealt with.

Example 2

Toner-guiding sheets were formed in the same manner as in Example 1, except that a polyphenylene sulfide film (trade name: "Torelina" made by Toray Industries, Inc.) 38 $\mu$m thick was used instead of the laminated film 40 um thick used in Example 1.

This film was confirmed to have a change in the amount of penetration δ when being left in the environment of a temperature of 45° C./a humidity of 60% RH for 30 days of 0.25 mm, and to have a creep-deformation resisting property in the invention.

The formed toner-guiding sheet 31 was bonded and fixed on the waste-toner receptacle 32 of the process cartridge 1 shown in FIG. 1 using a pressure sensitive adhesive double coated tape in the same manner as in Example 1.

Figure 6A:
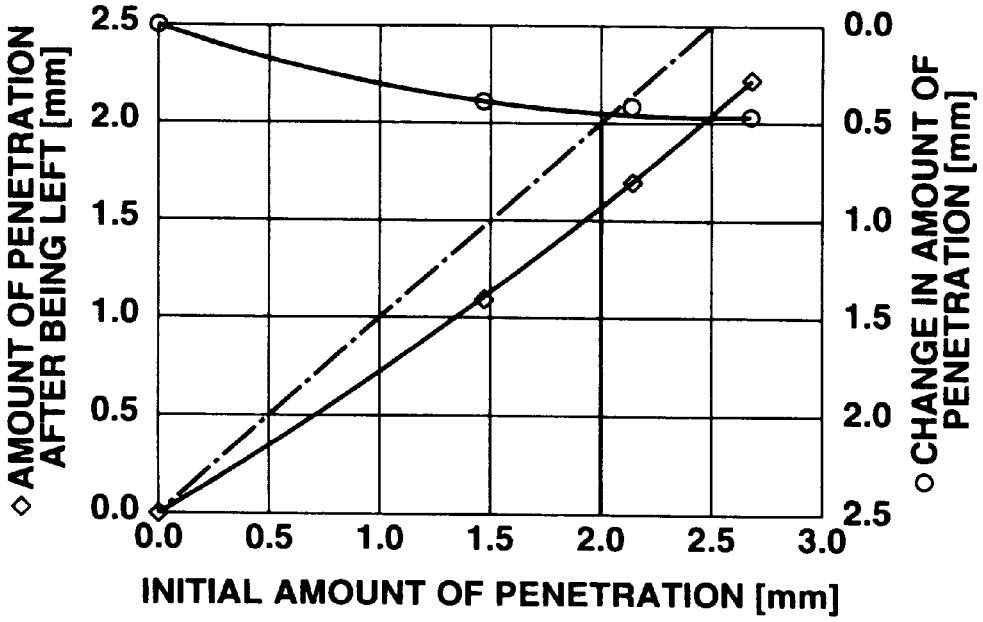
FIGS. 6A and 6B are graphs illustrating changes in an amount of penetration and changes in an amount of charge, respectively, due to creep deformation in a toner-guiding sheet made of a polyphenylene sulfide film in Example 2.
Figure 6B:
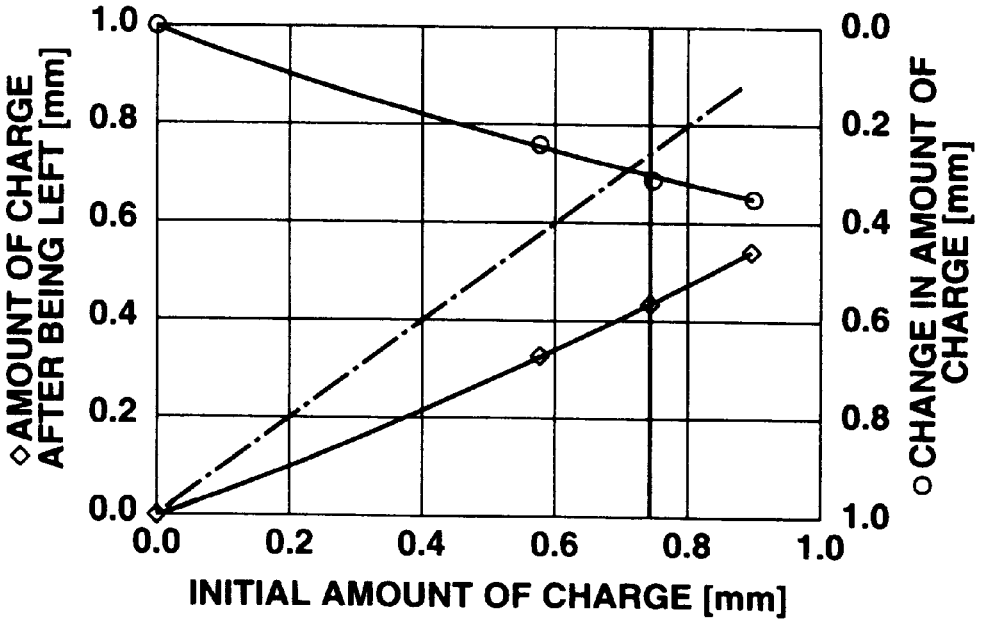

This process cartridge 1 was left in the environment of a temperature of 45° C./a humidity of 60% RH for 30 days in a state in which the process cartridge 1 was assembled. As shown in FIGS. 6A and 6B, the amount of penetration e of the central portion in the longitudinal direction of the contact portion of the sheet 31 with respect to the photosensitive drum 2 was 1.6 mm, and the amount of charge f of the central portion in the longitudinal direction with respect to the photosensitive drum 2 was 0.43 mm. Hence, the difference (c–e) between the initial amount of penetration c and the amount of penetration after being left e was 0.4 mm, and the difference (d–f) between the initial amount of charge d and the amount of charge after being left f was 0.31 mm.

A test of consecutive image forming operations was performed in the same manner as in Example 1. The result of the test indicates that a state in which the toner-guiding sheet 31 contacts the surface of the photosensitive drum 2 was maintained, toner particles scraped off by the cleaning blade 30 could be assuredly scooped, and leakage of toner particles did not occur.

Example 3

Toner-guiding sheets were formed in the same manner as in Example 2, except that a film (trade name: "Torelina" made by Toray Industries, Inc.) 0.5 $\mu$m thick was used.

This film was confirmed to have a change in the amount of penetration δ when being left in the environment of a temperature of 45° C./a humidity of 60% RH for 30 days of 0.38 mm, and to have a creep-deformation resisting property in the invention.

The formed toner-guiding sheet 31 was bonded and fixed on the waste-toner receptacle 32 of the process cartridge 1 shown in FIG. 1 using a pressure sensitive adhesive double coated tape in the same manner as in Example 1.

This process cartridge 1 was left in the environment of a temperature of 45° C./a humidity of 60% RH for 30 days in a state in which the process cartridge 1 was assembled. As shown in FIGS. 5A and 5B, the amount of penetration e of the central portion in the longitudinal direction of the contact portion of the sheet 31 with respect to the photosensitive drum 2 was 1.62 mm, and the amount of charge f of the central portion in the longitudinal direction of the contact portion of the sheet 31 with respect to the photosensitive drum 2 was 0.44 mm. Hence, the difference (c–e) between the initial amount of penetration c and the amount of penetration after being left e was 0.38 mm, and the difference (d–0 between the initial amount of charge d and the amount of charge after being left f was 0.3 mm.

A test of consecutive image forming operations was performed in the same manner as in Example 1. The result of the test indicates that a state in which the toner-guiding sheet 31 contacts the surface of the photosensitive drum 2 was maintained, toner particles scraped off by the cleaning blade 30 could be assuredly scooped, and leakage of toner particles did not occur. However, longitudinal stripe-shaped defects which can be visually confirmed were produced on the surface of the photosensitive drum 2 after consecutively forming 2,500 images, and longitudinal stripe-shaped unevenness in density was produced in halftone and entirely black images.

Example 4

The process cartridge 1 was manufactured by fixing the toner-guiding sheet 31 on the bonding surface of the waste-toner receptacle 32 in the same manner as in Example 1, except that the toner-guiding sheet 31 was bonded without curving the bonding surface of the waste-toner receptacle 32. A tension was not applied in the longitudinal direction of the free end portion 31B of the tone-guiding sheet 31, and a slight undulation was produced at the free end portion 31B of the toner-guiding sheet 31.

A test of consecutive image forming operations was performed in the same manner as in Example 1. The result of the test indicates that slight leakage of toner particles was found from gaps in the undulation starting from about 1,500-th sheet.

Comparative Example 1

Toner-guiding sheets were formed in the same manner as in Example 1, except that a monolayer polyester (polyethylene terephthalate) film (trade name: "Lumilar S" made by Toray Industries, Inc.) 38 μm thick was used instead of the laminated film 40 μm thick used in Example 1.

This film was confirmed to have a change in the amount of penetration δ when being left in the environment of a temperature of 45° C./a humidity of 60% RH for 30 days of 0.74 mm, and not to have a creep-deformation resisting property in the invention.

The formed toner-guiding sheet was bonded and fixed on the waste-toner receptacle 32 of the process cartridge 1 shown in FIG. 1 using a pressure sensitive adhesive double coated tape in the same manner as in Example 1.

This process cartridge 1 was left in the environment of a temperature of 45° C./a humidity of 60% RH for 30 days in a state in which the process cartridge 1 was assembled. As shown in FIGS. 3A and 3B, the amount of penetration e of the central portion in the longitudinal direction of the contact portion of the sheet 31 with respect to the photosensitive drum 2 was 1.26 mm, and the amount of charge f of the central portion in the longitudinal direction of the contact portion of the sheet 31 with respect to the photosensitive drum 2 was 0.29 mm. Hence, the difference (c–e) between the initial amount of penetration c and the amount of penetration after being left e was 0.74 mm, and the difference (d–f between the initial amount of charge d and the amount of charge after being left f was 0.45 mm.

A test of consecutive image forming operations was performed in the same manner as in Example 1. The result of the test indicates that leakage of toner particles occurs from the gap between the toner-guiding sheet 31 and the photosensitive drum 2 starting from about 500-th sheet in an environment of 35° C.

Comparative Example 2

Toner-guiding sheets were formed in the same manner as in Example 1, except that a monolayer polyester (polyethylene terephthalate) film (trade name: "Lumirror S" made by Toray Industries, Inc.) 50 μm thick was used instead of the laminated film 40 μm thick used in Example 1.

This film was confirmed to have a change in the amount of penetration δ when being left in the environment of a temperature of 45° C./a humidity of 60% RH for 30 days of 0.72 mm, and not to have a creep-deformation resisting property in the invention.

The formed toner-guiding sheet 31 was bonded and fixed on the waste-toner receptacle 32 of the process cartridge 1 shown in FIG. 1 using a pressure sensitive adhesive double coated tape in the same manner as in Example 1.

This process cartridge 1 was left in the environment of a temperature of 45° C./a humidity of 60% RH for 30 days in a state in which the process cartridge 1 was assembled. The amount of penetration e of the central portion in the longitudinal direction of the contact portion of the sheet 31 with respect to the photosensitive drum 2 was 1.28 mm, and the amount of charge f of the central portion in the longitudinal direction of the contact portion of the sheet 31 with respect to the photosensitive drum 2 was 0.3 mm. Hence, the difference (c–e) between the initial amount of penetration c and the amount of penetration after being left e was 0.72 mm, and the difference (d–f) between the initial amount of charge d and the amount of charge after being left f was 0.4 mm.

A test of consecutive image forming operations was performed in the same manner as in Example 1. The result of the test indicates that leakage of toner particles occurs from the gap between the toner-guiding sheet 31 and the photosensitive drum 2 starting from about 500-th sheet in an environment of 35° C., as in Comparative Example 1.

The individual components shown in outline in the drawings are all well known in the toner-guiding sheet, cleaning apparatus, process cartridge and image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner-guiding sheet for guiding toner removed from an image carrying member, comprising:

a free end portion for contacting a surface of the image carrying member; and a fixed portion, fixable on a fixing member, for fixing said toner-guiding sheet in a state in which said free end portion contacts the surface of the image carrying member, wherein said toner-guiding sheet comprises a film having a creep-deformation resisting property such that, when the film, fixed on the fixing member so that a distance β from a central portion in a longitudinal direction of said fixed portion of said sheet to a central portion in a longitudinal direction of said free end portion of said sheet is substantially 3.86 mm, is brought in contact with a surface of a contact member under conditions such that a distance α from the central portion in the longitudinal direction of said fixed portion of said sheet to a central portion in the longitudinal direction of a contact portion of said free end portion on the surface of the contact member is substantially 1.86 mm, an amount of penetration δ of the central portion in the longitudinal direction of said contact portion of said sheet with respect to the contact member is substantially 2.0 mm, and an amount of charge ξ of the central portion in the longitudinal direction of said contact portion of said sheet with respect to the contact member is substantially 0.74 mm, a change in the amount of penetration δ when leaving said toner-guiding sheet in an environment of a temperature of substantially 45° C./a humidity of substantially 60% RH for substantially 30 days is equal to or less than 0.43 mm.

2. A toner-guiding sheet according to claim 1, wherein said toner-guiding sheet comprises a laminated film having at least a creep-deformation resisting layer between polyester films.

3. A toner-guiding sheet according to claim 1, wherein said toner-guiding sheet comprises a laminated film having at least a creep-deformation resisting layer between polyethylene terephthalate films.

4. A toner-guiding sheet according to claim 1, wherein said toner-guiding sheet comprises a polyphenylene sulfide film.

5. A toner-guiding sheet according to claim 1, wherein said toner-guiding sheet has a thickness of substantially 35–45 μm.

6. A toner-guiding sheet according to claim 1, wherein said toner-guiding sheet is fixed in a state in which a tension is applied at least in the longitudinal direction of said free end portion.

7. A toner-guiding sheet according to claim 6, wherein said toner-guiding sheet is fixed in a state in which a tension smaller than the tension applied in the longitudinal direction of said free end portion is applied, or a tension is not applied, in the longitudinal direction of said fixed portion.

8. A toner-guiding sheet according to claim 6, wherein said toner-guiding sheet is fixed in a state in which a tension is applied at least in the longitudinal direction of said free end portion, by fixing the fixing member in a curved state and then releasing the curved state.

9. A toner-guiding sheet according to claim 6, wherein said toner-guiding sheet is fixed so that the amount of penetration with respect to the image carrying member is larger at the central portion of the image carrying member and the sheet than at two end portions in the longitudinal direction.

10. A cleaning apparatus comprising:

cleaning means for removing toner from a surface of an image carrying member; and a toner-guiding sheet for receiving the toner removed from the surface of the image carrying member, wherein said toner-guiding sheet comprises:

a free end portion for contacting the surface of the image carrying member; and a fixed portion, fixable on a fixing member, for fixing said toner-guiding sheet in a state in which said free end portion contacts the surface of the image carrying member, and wherein said toner-guiding sheet comprises a film having a creep-deformation resisting property such that, when the film, fixed on the fixing member so that a distance β from a central portion in a longitudinal direction of said fixed portion of said sheet to a central portion in the longitudinal direction of said free end portion of said sheet is substantially 3.86 mm is brought in contact with a surface of a contact member under conditions such that a distance α from the central portion in the longitudinal direction of said fixed portion of said sheet to a central portion in the longitudinal direction of a contact portion of said free end portion on the surface of the contact member is substantially 1.86 mm, an amount of penetration δ of the central portion in the longitudinal direction of said contact portion of said sheet with respect to the contact member is substantially 2.0 mm, and an amount of charge ξ of the central portion in the longitudinal direction of said contact portion of said sheet with respect to the contact member is substantially 0.74 mm, a change in the amount of penetration δ when leaving said toner-guiding sheet in an environment of a temperature of substantially 45° C./a humidity of substantially 60% RH for substantially 30 days is equal to or less than 0.43 mm.

11. A cleaning apparatus according to claim 10, wherein said toner-guiding sheet comprises a laminated film having at least a creep-deformation resisting layer between polyester films.

12. A cleaning apparatus according to claim 10, wherein said toner-guiding sheet comprises a laminated film having at least a creep-deformation resisting layer between polyethylene terephthalate films.

13. A cleaning apparatus according to claim 10, wherein said toner-guiding sheet comprises a polyphenylene sulfide film.

14. A cleaning apparatus according to claim 10, wherein said toner-guiding sheet has a thickness of substantially 35–45 μm.

15. A cleaning apparatus according to claim 10, wherein said toner-guiding sheet is fixed in a state in which a tension is applied at least in the longitudinal direction of said free end portion.

16. A cleaning apparatus according to claim 15, wherein said toner-guiding sheet is fixed in a state in which a tension smaller than the tension applied in the longitudinal direction of said free end portion is applied, or a tension is not applied, in the longitudinal direction of said fixed portion.

17. A cleaning apparatus according to claim 15, wherein said toner-guiding sheet is fixed in a state in which a tension is applied at least in the longitudinal direction of said free end portion, by fixing the fixed member in a curved state and then releasing the curved state.

18. A cleaning apparatus according to claim 15, wherein said toner-guiding sheet is fixed so that the amount of penetration with respect to the image carrying member is larger at the central portion than at two end portions thereof in the longitudinal direction.

19. A cleaning apparatus according to claim 10, wherein said toner-guiding sheet is fixed in a state of contacting said free end portion thereof to the surface of the image carrying member under conditions such that a distance a from a central portion in the longitudinal direction of said fixed portion of said sheet to a central portion in the longitudinal direction of the contact portion on the surface of the image carrying member is substantially 1.76–1.96 mm, a distance b from the central portion in the longitudinal direction of said fixed portion of said sheet to the central portion in the longitudinal direction of said free end portion of said sheet is substantially 3.76–4.96 mm, and an amount penetration c of the central portion in the longitudinal direction of said contact portion of said sheet with respect to the image carrying member is substantially 2.0–3.0 mm, and an amount of charge d of the central portion in the longitudinal direction of said contact portion of sheet with respect to the image carrying member is substantially 0.74–0.97 mm.

20. A cleaning apparatus according to claim 10, wherein said toner-guiding sheet is fixed in a state of contacting said free end portion thereof to the surface of the image carrying member under conditions such that a distance a from a central portion in the longitudinal direction of said fixed portion of said sheet to a central portion in the longitudinal direction of the contact portion on the surface of the image carrying member is substantially 1.76–1.96 mm, a distance b from the central portion in the longitudinal direction of said fixed portion of said sheet to the central portion in the longitudinal direction of said free end portion of said sheet is substantially 3.76–4.96 mm, and an amount penetration c of the central portion in the longitudinal direction of said contact portion of said sheet with respect to the image carrying member is substantially 2.0–3.0 mm, and an amount of charge d of the central portion in the longitudinal direction of said sheet with respect to the image carrying member is substantially 0.74–0.97 mm, and wherein, when said toner-guiding sheet is left in the environment of the temperature of substantially 45° C./the humidity of substantially 60% RH for substantially 30 days, an amount of penetration e of the central portion in the longitudinal direction of said contact portion of said sheet with respect to the image carrying member is substantially 1.57–2.37 mm, and an amount of charge f of the central portion in the longitudinal direction of said contact portion of said sheet with respect to the image carrying member is substantially 0.43–0.55 mm.

21. A process cartridge detachably mountable to a main body of an image forming apparatus, comprising:

an image carrying member for carrying an electrostatic latent image;

cleaning means for removing toner from a surface of an image carrying member; and a toner-guiding sheet for receiving the toner removed from the surface of the image carrying member, wherein said toner-guiding sheet comprises:

a free end portion, fixable on a fixing member, for contacting a surface of the image carrying member; and a fixed portion for fixing said toner-guiding sheet in a state in which said free end portion contacts the surface of the image carrying member, and wherein said toner-guiding sheet comprises a film having a creep-deformation resisting property such that, when the film, fixed on the fixing member so that a distance β from a central portion in a longitudinal direction of said fixed portion of said sheet to a central portion in a longitudinal direction of said free end portion of said sheet is substantially 3.86 mm is brought in contact with a surface of a contact member under conditions such that a distance α from the central portion in the longitudinal direction of said fixed portion of said sheet to a central portion in the longitudinal direction of a contact portion of said free end portion on the surface of the contact member is substantially 1.86 mm, an amount of penetration δ of the central portion in the longitudinal direction of said contact portion of said sheet with respect to the contact member is substantially 2.0 mm, and an amount of charge ξ of the central portion in the longitudinal direction of said contact portion of said sheet with respect to the contact member is substantially 0.74 mm, a change in the amount of penetration δ when leaving said toner-guiding sheet in an environment of a temperature of substantially 45° C./a humidity of substantially 60% RH for substantially 30 days is equal to or less than substantially 0.43 mm.

22. A process cartridge according to claim 21, wherein said toner-guiding sheet comprises a laminated film having at least a creep-deformation resisting layer between polyester films.

23. A process cartridge according to claim 21, wherein said toner-guiding sheet comprises a laminated film having at least a creep-deformation resisting layer between polyethylene terephthalate films.

24. A process cartridge cleaning apparatus according to claim 21, wherein said toner-guiding sheet comprises a polyphenylene sulfide film.

25. A process cartridge according to claim 21, wherein said toner-guiding sheet has a thickness of substantially 35–45 μm.

26. A process cartridge according to claim 21, wherein said toner-guiding sheet is fixed in a state in which a tension is applied at least in the longitudinal direction of said free end portion.

27. A process cartridge according to claim 26, wherein said toner-guiding sheet is fixed in a state in which a tension smaller than the tension applied in the longitudinal direction of said free end portion is applied, or a tension is not applied, in the longitudinal direction of said fixed portion.

28. A process cartridge according to claim 26, wherein said toner-guiding sheet is fixed in a state in which a tension is applied at least in the longitudinal direction of said free end portion, by fixing the fixed member in a curved state and then releasing the curved state.

29. A process cartridge according to claim 26, wherein said toner-guiding sheet is fixed so that the amount of penetration with respect to the image carrying member is larger at the central portion than at two end portions thereof in the longitudinal direction.

30. A process cartridge according to claim 21, wherein said toner-guiding sheet is fixed in a state of contacting said free end portion thereof to the surface of the image carrying member under conditions such that a distance a from a central portion in the longitudinal direction of said fixed portion of said sheet to a central portion in the longitudinal direction of the contact portion on the surface of the image carrying member is substantially 1.76–1.96 mm, a distance b from the central portion in the longitudinal direction of said fixed portion of said sheet to the central portion in the longitudinal direction of said free end portion of said sheet is substantially 3.76–4.96 mm, and an amount penetration c of the central portion in the longitudinal direction of said contact portion of said sheet with respect to the image carrying member is substantially 2.0–3.0 mm, and an amount of charge d of the central portion in the longitudinal direction of said contact portion of said sheet with respect to the image carrying member is substantially 0.74–0.97 mm.

31. A process cartridge according to claim 21, wherein said toner-guiding sheet is fixed in a state of contacting said free end portion thereof to the surface of the image carrying member under conditions such that a distance a from a central portion in the longitudinal direction of said fixed portion of said sheet to a central portion in the longitudinal direction of the contact portion on the surface of the image carrying member is substantially 1.76–1.96 mm, a distance b from the central portion in the longitudinal direction of said fixed portion of said sheet to the central portion in the longitudinal direction of said free end portion of said sheet is substantially 3.76–4.96 mm, and an amount penetration c of the central portion in the longitudinal direction of said contact portion of said sheet with respect to the image carrying member is substantially 2.0–3.0 mm, and an amount of charge d of the central portion in the longitudinal direction of said contact portion of said sheet with respect to the image carrying member is substantially 0.74–0.97 mm, and wherein, when said toner-guiding sheet is left in the environment of a temperature of substantially 45° C./a humidity of substantially 60% RH for substantially 30 days, an amount of penetration e of the central portion in the longitudinal direction of said contact portion of said sheet with respect to the image carrying member is substantially 1.57–2.37 mm, and an amount of charge f of the central portion in the longitudinal direction of said contact portion of said sheet with respect to the image carrying member is substantially 0.43–0.55 mm.

32. A process cartridge according to claim 21, wherein said image carrying member comprises an electrophotographic photosensitive member.

33. A process cartridge according to claim 21, further comprising toner in addition to said image carrying member, said cleaning means, and said toner-guiding sheet.

34. An image forming apparatus to which a process cartridge is detachably mounted for forming an image on a recording sheet, said image forming apparatus comprising:

mounting means for mounting the process cartridge comprising an image carrying member for carrying an electrostatic latent image, cleaning means for removing toner from a surface of the image carrying member, and a toner-guiding sheet for receiving the toner removed from the surface of the image carrying member by the cleaning means; and conveying means for conveying the recording sheet, wherein said toner-guiding sheet comprises:

a free end portion for contacting the surface of the image carrying member; and a fixed portion, fixable on a fixing member, for fixing said toner-guiding sheet in a state in which said free end portion contacts the surface of the image carrying member, and wherein said toner-guiding sheet comprises a film having a creep-deformation resisting property such that, when the film, fixed on the fixing member so that a distance β from a central portion in a longitudinal direction of said fixed portion of said sheet to a central portion in a longitudinal direction of said free end portion of said sheet is substantially 3.86 mm is brought in contact with a surface of a contact member under conditions such that a distance α from the central portion in the longitudinal direction of said fixed portion of said sheet to a central portion in the longitudinal direction of a contact portion of said free end portion on the surface of the contact member is substantially 1.86 mm, an amount of penetration δ of the central portion in the longitudinal direction of said contact portion of said sheet with respect to the contact member is substantially 2.0 mm, and an amount of charge ξ of the central portion in the longitudinal direction of said contact portion of said sheet with respect to the contact member is substantially 0.74 mm, a change in the amount of penetration δ when leaving said toner-guiding sheet in an environment of a temperature of substantially 45° C./a humidity of substantially 60% RH for substantially 30 days is equal to or less than substantially 0.43 mm.

35. An image forming apparatus according to claim 34, wherein said toner-guiding sheet comprises a laminated film having at least a creep-deformation resisting layer between polyester films.

36. An image forming apparatus according to claim 34, wherein said toner-guiding sheet comprises a laminated film having at least a creep-deformation resisting layer between polyethylene terephthalate films.

37. An image forming apparatus according to claim 34, wherein said toner-guiding sheet comprises a polyphenylene sulfide film.

38. An image forming apparatus according to claim 34, wherein said toner-guiding sheet has a thickness of substantially 35–45 μm.

39. An image forming apparatus according to claim 34, wherein said toner-guiding sheet is fixed in a state in which a tension is applied at least in the longitudinal direction of said free end portion.

40. An image forming apparatus according to claim 39, wherein said toner-guiding sheet is fixed in a state in which a tension smaller than the tension applied in the longitudinal direction of said free end portion is applied, or a tension is not applied, in the longitudinal direction of said fixed portion.

41. An image forming apparatus according to claim 39, wherein said toner-guiding sheet is fixed in a state in which a tension is applied at least in the longitudinal direction of said free end portion, by fixing the fixed member in a curved state and then releasing the curved state.

42. An image forming apparatus according to claim 39, wherein said toner-guiding sheet is fixed so that the amount of penetration with respect to the image carrying member is larger at the central portion of the image carrying member and said sheet than at two end portions thereof in the longitudinal direction.

43. An image forming apparatus according to claim 34, wherein said toner-guiding sheet is fixed in a state of contacting said free end portion thereof to the surface of the image carrying member under conditions such that a distance a from a central portion in the longitudinal direction of said fixed portion of said sheet to a central portion in the longitudinal direction of the contact portion on the surface of the image carrying member is substantially 1.76–1.96 mm, a distance b from the central portion in the longitudinal direction of said fixed portion of said sheet to the central portion in the longitudinal direction of said free end portion of said sheet is substantially 3.76–4.96 mm, and an amount penetration c of the central portion in the longitudinal direction of said contact portion of said sheet with respect to the image carrying member is substantially 2.0–3.0 mm, and an amount of charge d of the central portion in the longitudinal direction of said contact portion of said sheet with respect to the image carrying member is substantially 0.74–0.97 mm.

44. An image forming apparatus according to claim 34, wherein said toner-guiding sheet is fixed in a state of contacting said free end portion thereof to the surface of the image carrying member under conditions such that a distance a from a central portion in the longitudinal direction of said fixed portion of said sheet to a central portion in the longitudinal direction of the contact portion on the surface of the image carrying member is substantially 1.76–1.96 mm, a distance b from the central portion in the longitudinal direction of said fixed portion of said sheet to the central portion in the longitudinal direction of said free end portion of said sheet is substantially 3.76–4.96 mm, and an amount penetration c of the central portion in the longitudinal direction of said contact portion of said sheet with respect to the image carrying member is substantially 2.0–3.0 mm, and an amount of charge d of the central portion in the longitudinal direction of said contact portion of said sheet with respect to the image carrying member is substantially 0.74–0.97 mm, and wherein, when said toner-guiding sheet is left in the environment of a temperature of substantially 45° C./a humidity of substantially 60% RH for substantially 30 days, an amount of penetration e of the central portion in the longitudinal direction of said contact portion of said sheet with respect to the image carrying member is substantially 1.57–2.37 mm, and an amount of charge f of the central portion in the longitudinal direction of said contact portion of said sheet with respect to the image carrying member is substantially 0.43–0.55 mm.

45. An image forming apparatus according to claim 34, wherein said image carrying member comprises an electrophotographic photosensitive member.

46. An image forming apparatus according to claim 34, further comprising toner in addition to said image carrying member, said cleaning means, and said toner-guiding sheet.

* * * * *

UNITED STATES PATENT AND TRADEMARK OFFICE

CERTIFICATE OF CORRECTION

PATENT NO. : 6,169,867 B1
DATED : January 2, 2001
INVENTOR(S) : Satoshi Kurihara It is certified that error appears in the above-identified patent and that said Letters Patent is hereby corrected as shown below:

Column 3,
Line 2, "polyethylene" should read -- polyphenylene --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*